United States Patent [19]

Lyu

[11] 4,065,951

[45] Jan. 3, 1978

[54] SPLIT PUNCH FOR DRAWING AND IRONING CONTAINERS

[75] Inventor: Seung W. Lyu, Homewood, Ill.

[73] Assignee: National Can Corporation, Chicago, Ill.

[21] Appl. No.: 738,479

[22] Filed: Nov. 3, 1976

[51] Int. Cl.[2] ..... B21D 22/00

[52] U.S. Cl. ..... 72/349; 72/479; 113/120 H

[58] Field of Search ..... 72/347, 348, 349, 476, 72/479; 220/66, 70; 113/120 H, 7 R, 7 A, 1 G

[56] References Cited

U.S. PATENT DOCUMENTS

| | | | |
|---|---|---|---|
| 1,173,793 | 2/1916 | Seay | 72/348 X |
| 2,859,870 | 11/1958 | Hitz | 72/347 |
| 3,423,985 | 1/1969 | Stolle et al. | 113/120 H X |
| 3,951,296 | 4/1976 | Swanson | 72/349 |

*Primary Examiner*—Leon Gilden

*Attorney, Agent, or Firm*—Robert A. Stenzel; Ralph R. Rath

[57] ABSTRACT

A split punch tool for cooperating with a die block to form the wall of a drawn and ironed container is disclosed herein. The split punch or cooperating die includes a female portion that has a peripheral lip that can be placed in overhanging relation to the periphery of the die block and the female portion has a peripheral ledge which extends perpendicular to the direction of movement of the die block and die with respect to each other and also an inclined surface extending from the inner edge of the ledge or inwardly directed surface. The surfaces are adapted to engage mating surfaces defined on the end of a cylindrical member that forms part of the cooperating die so that the ledge defines a perpendicular support for the cylindrical member.

7 Claims, 4 Drawing Figures

SPLIT PUNCH FOR DRAWING AND IRONING CONTAINERS

BACKGROUND OF THE INVENTION

The present invention relates generally to metal containers and more specifically to the manufacture of drawn, extruded and/or ironed containers. In the formation of these containers, a flat blank is severed from a continuous sheet of stock material and is formed in several steps to produce a container that has a cylindrical sidewall and a bottom or end wall integral with the sidewall and formed to a particular configuration to increase resistance to pressure interally of the container.

One container that has received a remarkable degree of attention is the type that is disclosed in U.S. Pat. No. 3,942,673, which is assigned to the assignee of the present invention. This patent discloses a drawn and ironed container that has a particular configuration between the sidewall of the container and an ellipsoidal dome which forms the major part of the bottom wall. In the formation of a container of this type, a flat blank is normally drawn to an intermediate configuration which includes a cylindrical sidewall and a flat bottom wall which is integral with the sidewall through an inclined peripheral flat wall. The container is then formed to its final configuration through a pair of dies that respectively cooperate with inner and outer surfaces of the container.

In the formation of drawn and ironed containers of the type under consideration, it has been highly desirable to form the die member that is received inside of the container as a "split punch design." In the formation of the split punch design, a female portion formed of one material cooperates with a generally cylindrical member to form the cooperating die that is received inside the container during the final formation of the bottom wall.

With this arrangement the ironed and domed container can be positively removed from the punch assembly by separation of the cylindrical member or punch sleeve from the female portion or nose piece at the end of the punch stroke.

This means that the female portion or nose portion of the die can be formed from a metal, such as steel, while the cylindrical portion of the die, which engages the sidewall of the container can be formed from a material such as carbide. It has been found that the use of carbide for the major portion of the die results in better stripping of the die from the container after it has been ironed and longer life for the dies as well as a better surface finish on the inner surface of the container which, therefore, requires less subsequent coating before the container is filled with product.

In the formation of the split punch design, it has been customary in the past to have the adjacent surfaces of the nose portion and the sleeve located at an angle with respect to the axis of the container so that the nose portion and sleeve can easily be split. It has been determined that utilizing a surface that is inclined with respect to the axis of the container as the mating surface between the two members on the periphery thereof simplifies the matching of the two surfaces.

However, it has also been determined that such a mating arrangement creates other problems which reduces the service life of the unit. For example, it has been found that the two inclined surfaces that define the mating surface between the punch and the nose wear rapidly, which will result in having the periphery of the two members at the joint being offset from each other. This arrangement results in producing an undesired deformation or sharp line in the area between the sidewall and the bottom wall. This wearing of the two surfaces is further aggravated by the fact that there is relative movement between the two surfaces each time the nose portion and the punch portion are engaged with each other.

Another problem encountered with the split punch design as has previously been utilized is that, when a jam or other malfunctioning of the press occurs, it results in misalignment of the peripheral edges of the two members and can cause chipping of the sharp point on the lower end of the carbide member. Thus, manufacturers must constantly replace the entire unit which is fairly expensive procedure. It will be appreciated that the cost of a cylindrical member formed of carbide is extremely high and any changes that can be made to increase the service life thereof results in substantial savings in manufacturing costs.

SUMMARY OF THE INVENTION

It has been determined that the service life of a split punch design utilized with a die block can be substantially increased by changing the configuration of the mating surfaces between the two members. The service life of a split punch die tool can be increased substantially by producing a flat portion on the mating surface which extends perpendicular to the path of movement of the punch.

More specifically, the die that cooperates with a die block to form the bottom and sidewall of a container includes a female portion that cooperates with the die block. The female portion has a peripheral inwardly directed surface extending perpendicular to an axis for the container to define a peripheral ledge. An inclined mating surface extends from the inner edge of the inwardly directed surface and a cylindrical member of the cooperating die has an end surface which corresponds to and engages the inwardly directed surface as well as the inclined surface so that the ledge defined by the inwardly directed surface produces a support which extends perpendicular to the path of relative movement of the die block and the cooperating die.

It has also been found that the width of the ledge on the periphery of the female or nose portion of the die is important. It has been determined that the dimension or width of the ledge or surface is preferably greater than 0.025 inches and is less than the radius of a peripheral lip portion on the lower end of the female portion which is arcuate in cross section.

DETAILED DESCRIPTION

Figure 1:
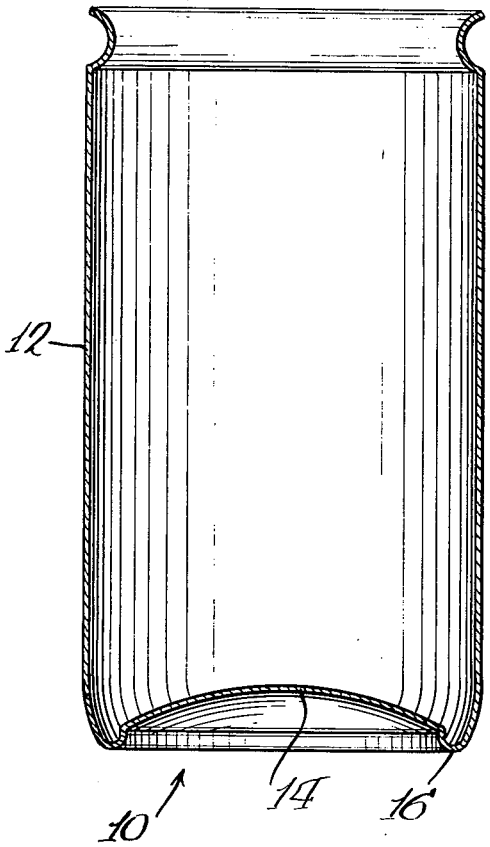
FIG. 1 illustrates a finished container which is formed through a drawing and ironing process.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

As was indicated above, in the manufacture of drawn, extruded and/or ironed containers, a flat circular blank is cut from a sheet of stock material and is simultaneously formed into a shallow cup. The shallow cup is then reformed in a multi-stage process to produce a cylindrical sidewall and a flat bottom wall that is connected to the sidewall by a peripheral inclined wall. The last step in the forming process is that the flat bottom wall and inclined interconnecting wall are reformed to the final configuration. The final container wall then consists of a circular sidewall 12 and a bottom or end wall 14 that is interconnected by an intermediate wall portion 16. Container 10 preferably has a configuration for bottom wall 14 and intermediate wall portion 16 that is disclosed in U.S. Pat. No. 3,942,673, the portions of which are not inconsistent with the present disclosure being incorporated herein by reference.

Figure 2:
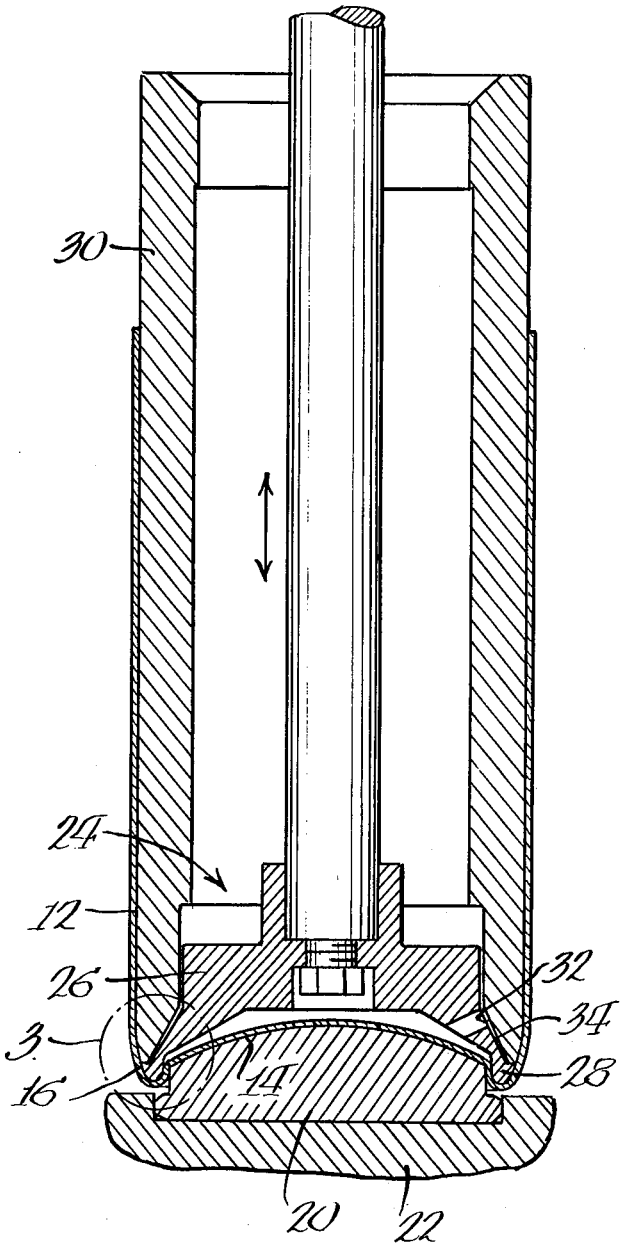
FIG. 2 is a sectional view through the forming apparatus and the container showing the container bottom wall after it has been formed.

In the final step of forming the container, a male die block 20 supported in a support 22 is adapted to engage an intermediate portion of bottom wall 14 while a cooperating die 24 engages the inner surface of both bottom wall 14 and sidewall 12. Cooperating die 24 consists of a female portion 26 that has a peripheral lip 28 which is configured to produce the final configuration for intermediate portion of wall 16. As shown in FIG. 2, peripheral lip or projection 28 is designed to be placed in overhanging relation with respect to the periphery of die block 20. Cooperating die 24 also includes a cylindrical member 30 that has a surface 32 at the lower end thereof which mates with a surface 34 defined on the periphery of female portion 26. As more clearly shown in FIG. 4, in the prior art die illustrated in FIG. 4, mating surfaces 32 and 34 are both inclined to define an acute angle with respect to a plane extending perpendicular to the path of relative movement of die block 20 and cooperating die 24. This arrangement was felt desirable since it simplified the matching of the two surfaces 32 and 34 with respect to each other and also made it easier to separate the die members 30 and 26 which is normally done after a container has been formed to the configuration illustrated in FIG. 2. For example, after the container bottom wall has been formed as indicated, cylindrical member or outer die element 30 would be retracted from the container while the container was held in a fixed position through die block 20 and die element 26. Thereafter, die element or female portion 26 could readily be removed from the container.

The arrangement so far described allows for the manufacturer to utilize a lubricant bearing or other low frictional material, such as carbide, for the cylindrical member 30 which engages the sidewall 12 of the container while utilizing a less expensive material for the female portion or nose portion 26 of the inner die 24. However, as indicated above, it was found that any wear on adjacent surfaces 32 and 34 would result in having the juncture 40 between die elements 26 and 30 offset from each other which would result in scarring the inner surface of the container during the forming step. Furthermore, with such an arrangement, when the offset occurred, it could also easily cause small chips in the sharp peripheral edge defined between surface 32 and a peripheral surface 42 of cylindrical member 30. Once the chipping occurred, the expensive cylindrical member 30 would have to be replaced.

Figure 3:
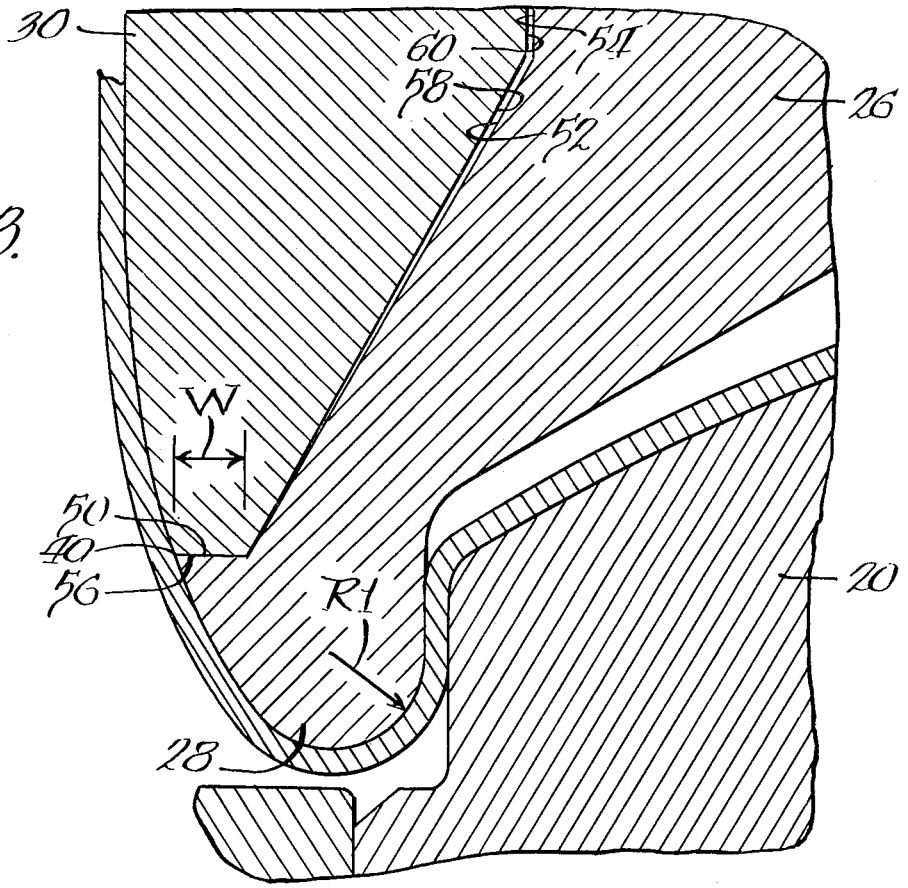
FIG. 3 is an enlarged fragmentary sectional view showing the circled portion of the die in FIG. 2.
Figure 4:
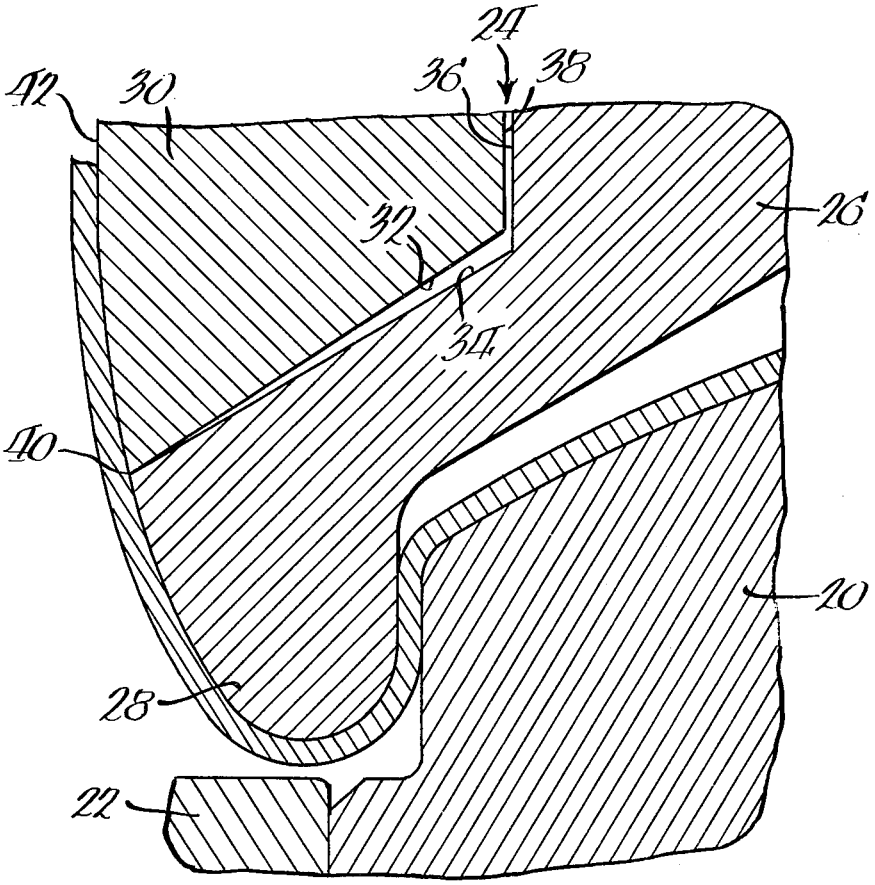
Fig. 4. PRIOR ART
FIG. 4 is a view similar to FIG. 3 showing the prior art type of die.

Applicant has determined that the service life of a split punch tool of the type disclosed in FIG. 4 can be increased substantially by changing the configuration of the mating surfaces 32 and 34. Stated another way, it has been determined that the service life of a split punch tool design can be substantially increased by changing the contact area between cylindrical member 30 and female portion 26. As illustrated in FIG. 3, the configuration of the mating surface between female portion or nose piece 26 and cylindrical member of punch sleeve 30 incorporates an inwardly directed surface 50 which extends perpendicular to the path or direction of relative movement between die block 20 and cooperating die 24, indicated by arrows in FIG. 2. The inwardly directed surface 50 merges at its inner end with an inclined surface 52 which inclines inwardly and upwardly and merges with a cylindrical surface 54 that extends parallel to the axis of the container as well as the path of movement of die elements 20 and 24. Cylindrical member or punch sleeve 30 has a lower end which also has a generally horizontal surface 56 that mates with surface 54, as well as an inclined surface 58 that mates generally with inclined surface 52 and an upper cylindrical surface 60 which generally mates with surface 54. Thus, surfaces 56, 58 and 60 define an end surface on member 30 which corresponds to and engages surfaces 50, 52 and 54.

It has been found that by utilizing the inwardly directed mating surfaces 50 and 56 which define a horizontal flat contact point between die member 26 and 30 not only provides good support for the brittle punch sleeve 30 that is formed of carbide but also minimizes or eliminates a mismatch condition at the point of split between the two.

It has also been found that the particular width of the flat contact ledge 50 can be correlated to the overall configuration of the end dome. For example, lip portion or peripheal nose 28 of the female portion 26 is generally arcuate in cross section at the lower end thereof and this arcuate cross section has a radius R1 as indicated in FIG. 3. The flat ledge defined by surface 50 has a width indicated by the reference numeral W. Preferably, the width W of the ledge defined by surface 50 has a dimension which is greater than 0.025 for forming a standard 12 ounce container. Also, the width W of ledge 50 is less than the radius R1 for arcuate lip portion 28, which in the illustrated container is 0.065 inches. Also, the included angle A between surfaces 50 and 52 is preferably $135° \pm 20°$.

While not limited to any specific dimensions, it has been found that a flat annular ledge 50 having a width of approximately 0.040 inches of flat contact area between die elements 26 and 30 substantially increases the service life for the punch sleeve and nose piece, particularly the punch sleeve. By increasing the service life of the punch sleeve which is made from a carbide material, the cost of manufacturing containers can be decreased substantially. As can be appreciated from a comparison of FIGS. 3 and 4, the point of contact 40 on the periphery of the two die elements 26 and 30 substantially reduces the possibility of having the lower end of die element 30 chipped during normal use or when the press jams or malfunctions for various other reasons.

What is claimed is:

1. Apparatus for forming a wall of a circular container including a bottom wall and a sidewall comprising a die block adapted to engage an outer surface of said bottom wall and a cooperating die adapted to engage an inner surface of said bottom wall and sidewall, said cooperating die including a female portion cooperating with said die block and having a peripheral lip adapted to be placed in overhanging relation to the periphery of said die block, said female portion having a peripheral inwardly directed surface extending perpendicular to an axis for said female portion to define a peripheral ledge above said peripheral lip, said female portion having an inclined surface extending from an inner edge of said inwardly directed surface, said cooperating die including a cylindrical member having an end surface corresponding to and engaging said inwardly directed surface and said inclined surface so that said ledge defines a support extending perpendicular to the path of relative movement of said die block and said cooperating die.

2. Apparatus as defined in claim 1, in which said peripheral lip is arcuate in cross section and said ledge has a width that is less than the radius of said peripheral lip.

3. Apparatus as defined in claim 2, in which said ledge has a width greater than 0.025 inches.

4. Apparatus as defined in claim 1, in which said ledge has a width of approximately 0.040 inches.

5. Apparatus for forming a wall of a circular container including a bottom wall and a sidewall comprising a die block adapted to engage an outer surface of said bottom wall and a cooperating die adapted to engage an inner surface of said bottom wall and sidewall, said cooperating die including a female portion cooperating with said die block and a cylindrical sleeve having a cylindrical axis and cooperating with said female portion and movable with resepct to said female portion, said female portion having a peripheral inwardly directed substantially flat surface extending perpendicular to the axis for said cylindrical sleeve to define a peripheral annular ledge adjacent said cylindrical sleeve, said female portion having an annular inclined flat surface extending from an inner edge of said ledge and converging toward said axis, said cylindrical sleeve having an end surface corresponding to and engaging said inwardly directed surface and said inclined surface so that said ledge defines a support extending perpendicular to the path of relative movements of said die block and said cooperating die.

6. Apparatus as defined in claim 5, in which said peripheral annular ledge has a width in the range of 0.025 to 0.065 inches.

7. Apparatus as defined in claim 5, in which said peripheral annular ledge has a width of approximately 0.040 inches.

* * * * *